US006286274B1

(12) United States Patent
McKann et al.

(10) Patent No.: US 6,286,274 B1
(45) Date of Patent: Sep. 11, 2001

(54) CLIP MOUNTING SYSTEM FOR DOOR FRAME

(75) Inventors: H. Smith McKann; Wendell Haney, both of Fredericksburg, VA (US)

(73) Assignee: Therma-Tru Virginia Company Incorporated LLC, Fredericksburg, VA (US)

( * ) Notice: Subject to any disclaimer, the term of this patent is extended or adjusted under 35 U.S.C. 154(b) by 0 days.

(21) Appl. No.: 09/290,617

(22) Filed: Apr. 13, 1999

(51) Int. Cl.[7] ..... E06B 1/04

(52) U.S. Cl. ..... 52/204.1; 52/212; 49/505

(58) Field of Search ..... 52/204.1, 211, 52/212, 217, 213; 49/504, 505

(56) References Cited

U.S. PATENT DOCUMENTS

| | | | | |
|---|---|---|---|---|
| 1,747,415 | * | 2/1930 | Baum | 52/213 |
| 1,966,666 | * | 7/1934 | Grimes | 52/213 |
| 2,742,117 | * | 4/1956 | Tolman | 52/213 |
| 3,189,137 | * | 6/1965 | Harris | 52/213 |
| 3,320,705 | | 5/1967 | Downing, Jr. . | |
| 3,401,487 | | 9/1968 | Brandt et al. . | |
| 3,420,003 | | 1/1969 | Cline . | |
| 3,545,135 | | 12/1970 | Lieber . | |
| 3,654,734 | * | 4/1972 | Lehman | 49/505 |
| 3,788,019 | | 1/1974 | Kiselewski . | |
| 3,793,788 | | 2/1974 | Collins . | |
| 3,906,671 | | 9/1975 | Maldonado . | |
| 3,994,243 | * | 11/1976 | Anders | 52/212 |
| 4,179,849 | * | 12/1979 | Kuffner | 49/505 |
| 4,281,480 | * | 8/1981 | Wendt | 49/504 |
| 4,510,722 | | 4/1985 | van Wieringen . | |
| 4,793,109 | | 12/1988 | Noach . | |
| 4,878,325 | * | 11/1989 | Van Tuyl et al. | 49/505 |
| 4,894,955 | * | 1/1990 | Metz | 49/504 |
| 5,187,898 | | 2/1993 | McKann . | |
| 5,233,802 | * | 8/1993 | Rogers | 52/212 |
| 5,771,644 | * | 6/1998 | Kidd | 52/213 |

* cited by examiner

*Primary Examiner*—Daniel P. Stodola
*Assistant Examiner*—Curtis A. Cohen
(74) *Attorney, Agent, or Firm*—Roylance, Abrams, Berdo & Goodman, L.L.P.

(57) ABSTRACT

A coupling for mounting a door frame in an opening in a wall includes two, substantially identical anchoring clips and two substantially identical retaining clips. Each anchoring clip has a base mounting portion and a resilient cantilever portion extending at an non-perpendicular angle from its base mounting portion. The anchor clips are oriented opposite to one another. Each retaining clip has a base mounting section and an angled section extending in an cantilever manner from its base mounting section. The retaining clips are oriented mirror image such that the cantilever portions of the anchoring clips engage the angled sections of the retaining clips.

20 Claims, 6 Drawing Sheets

CLIP MOUNTING SYSTEM FOR DOOR FRAME

FIELD OF THE INVENTION

The present invention relates to a coupling for mounting a door frame in a wall opening including anchoring clips mounted on one of the frame and wall and retaining clips mounted on the other of the frame and wall. The anchoring and retaining clips engage to secure the frame in the wall opening. More particularly, the present invention relates to a coupling wherein the anchoring clips are identical and have resilient cantilever portions and wherein the retaining clips are identical and have angled sections engaged by the cantilever portions.

BACKGROUND OF THE INVENTION

Conventional building industry practice uses prefabricated door frame assemblies which are manufactured at a manufacturing facility and then transported to a remote location for installation. This assembly includes a frame as well as a pre-hung door. The door frame includes a header jamb assembly for the top of the doorway opening in a wall and latch and hinge jamb assemblies for the sides of the doorway opening in the wall. To accommodate for variations in the thickness of the wall in which a door is located, the frame is adjustable to accommodate these wall thicknesses. Additionally, the frame should be adaptable to wide variety of uses, including the addition of a screen or storm door and the addition or omission of exterior trim.

A typical frame of this type is disclosed in U.S. Pat. No. 5,187,898 to McKann, entitled Adjustable Door Frame, the subject matter of which is hereby incorporated by reference. This frame is secured to the wall in the doorway opening by screws passing through the frame outside of and adjacent to the opening, as well as by screws passing through the portion of the frame inside the doorway opening and into the wall part defining the doorway opening. To provide a secure connection, the screws are within the normal field of vision and provide an unsightly appearance. Additionally, such screws require the use of considerable labor time by skilled installers.

Clip systems have been used for securing door frames in position. Typical clip systems are disclosed in U.S. Pat. No. 3,788,019 to Kiselewski, U.S. Pat. No. 3,545,135 to Lieber, U.S. Pat. No. 3,320,705 to Downing and U.S. Pat. No. 4,510,722 to van Wieringen.

However, these conventional clip mounting systems for door frames are not adequately simple and inexpensive to use and manufacture.

SUMMARY OF THE INVENTION

Accordingly, an object of the present invention is to provide a coupling for mounting a door frame in an opening and a door frame assembly including a mounting coupling which can be easily and economically manufactured and installed.

Another object of the present invention is to provide a coupling for mounting a door frame in an opening in a wall and a door frame assembly which eliminates screws in the normal field of vision.

Yet another object of the present invention is to provide a coupling for mounting a door frame and a door frame assembly which is rugged and of sturdy construction, and facilitates rapid installation.

The foregoing objects are basically obtained by a coupling for mounting a door in an opening in a wall, comprising substantially identical first and second anchoring clips and substantially identical first and second retaining clips. Each anchoring clip includes a base mounting portion and a resilient cantilever portion extending at a non-perpendicular angle from the base mounting portion. The two anchoring clips are oriented opposite to one another. Each retaining clip has a base mounting section and an angled section extending in a cantilever manner from its base mounting section. The two retaining clips are oriented in mirror image to one another such that the cantilever portions respectively engage the angled portions of the first and second retaining clips.

By forming the coupling in this manner, the anchoring clips and retaining clips can be inexpensively and easily formed from sheet metal. The manufacturing costs are substantially reduced by the two anchoring clips being identical and the two retaining clips being identical. In this manner, only two, relatively simple parts need to be manufactured and supplied for forming the coupling. The simple forms and identical constructions of the two anchoring clips and of the two retaining clips also simplify and facilitate the installation.

With these clips, the door frame can be retained and located simply within the doorway opening by snapping it into place. Any additional screws which may be necessary would be located at the bottom and/or top ends of the hinge and latch jambs, well away from the normal field of vision. Further, the clips greatly simplify the installation by eliminating the number of screws that would otherwise be necessary for securing the door frame within the doorway opening in a wall.

Other objects, advantages and salient features of the present invention will become apparent from the following detailed description, which, taken in conjunction with the annexed drawings, discloses preferred embodiments of the present invention.

DETAILED DESCRIPTION OF THE PREFERRED EMBODIMENTS

Figure 1:
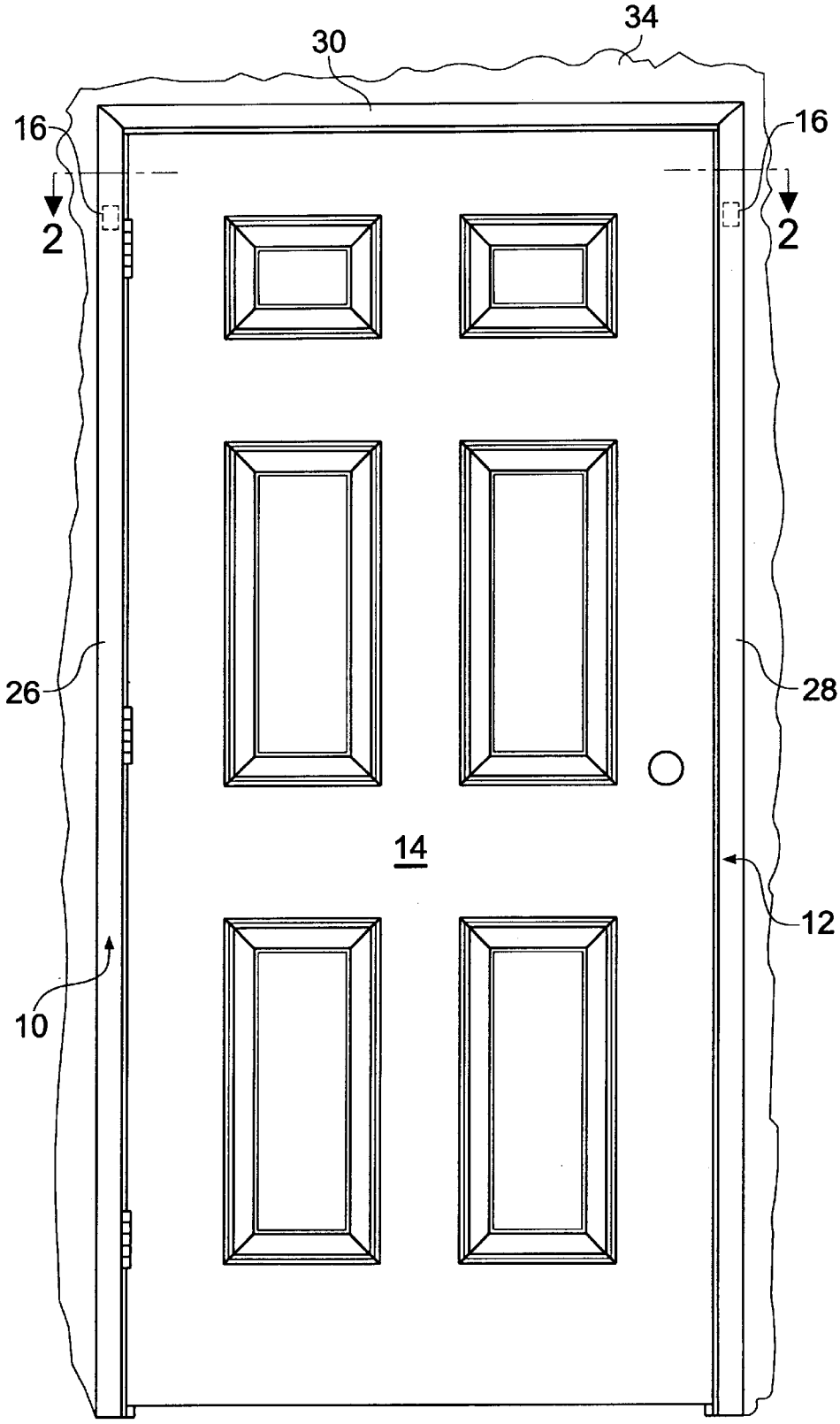
FIG. 1 is a front elevational view of a door frame assembly mounted in a doorway opening in a wall with a mounting coupling according to a first embodiment of the present invention.
Figure 2:
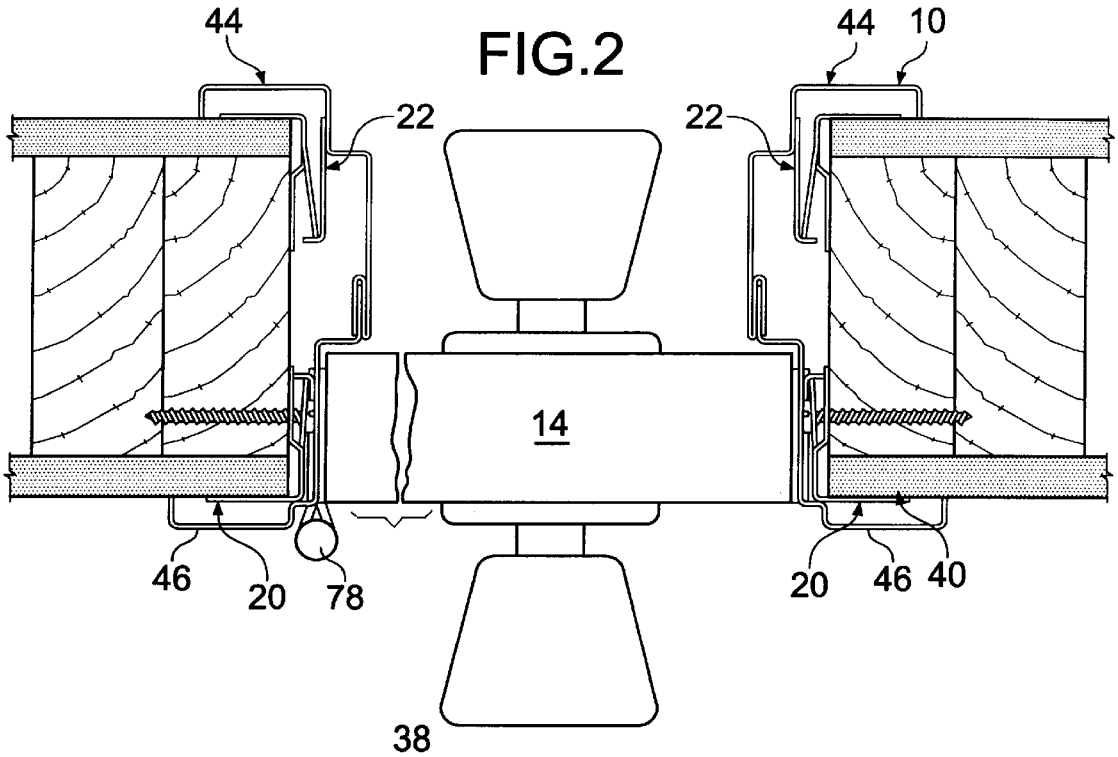
FIG. 2 is a partial, top plan view in section taken along lines 2—2 of FIG. 1.
Figure 3:
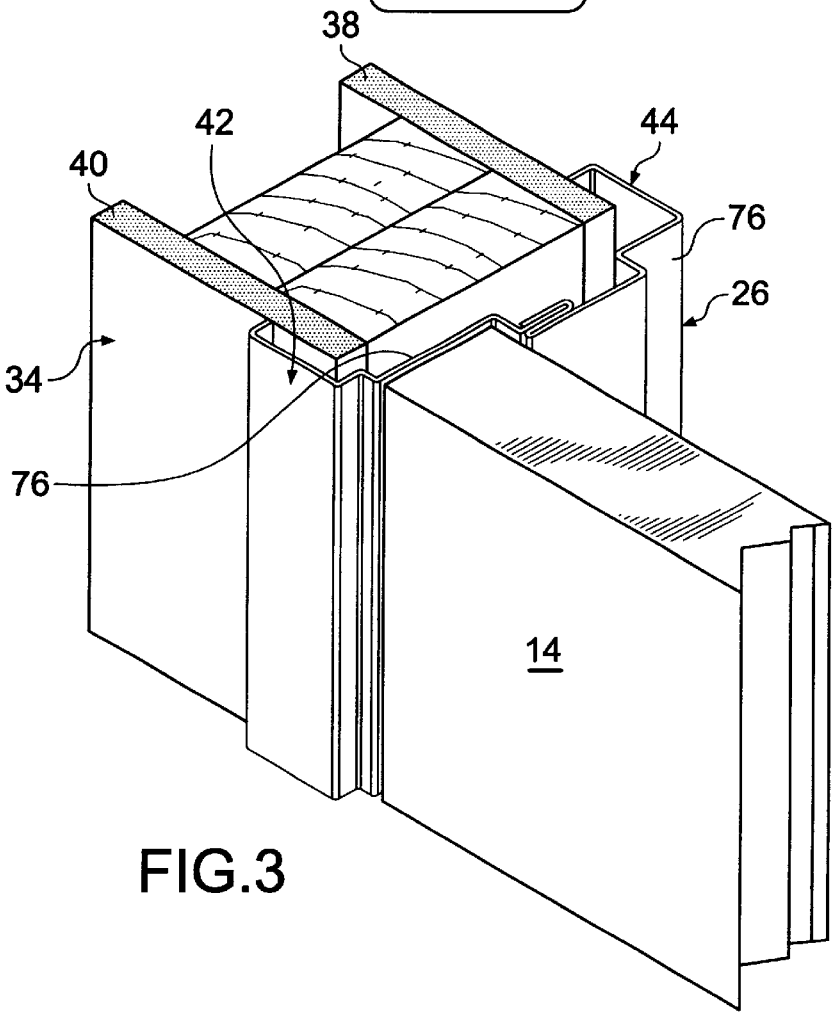
FIG. 3 is a partial, perspective view of the door frame assembly of FIG. 1.
Figure 4:
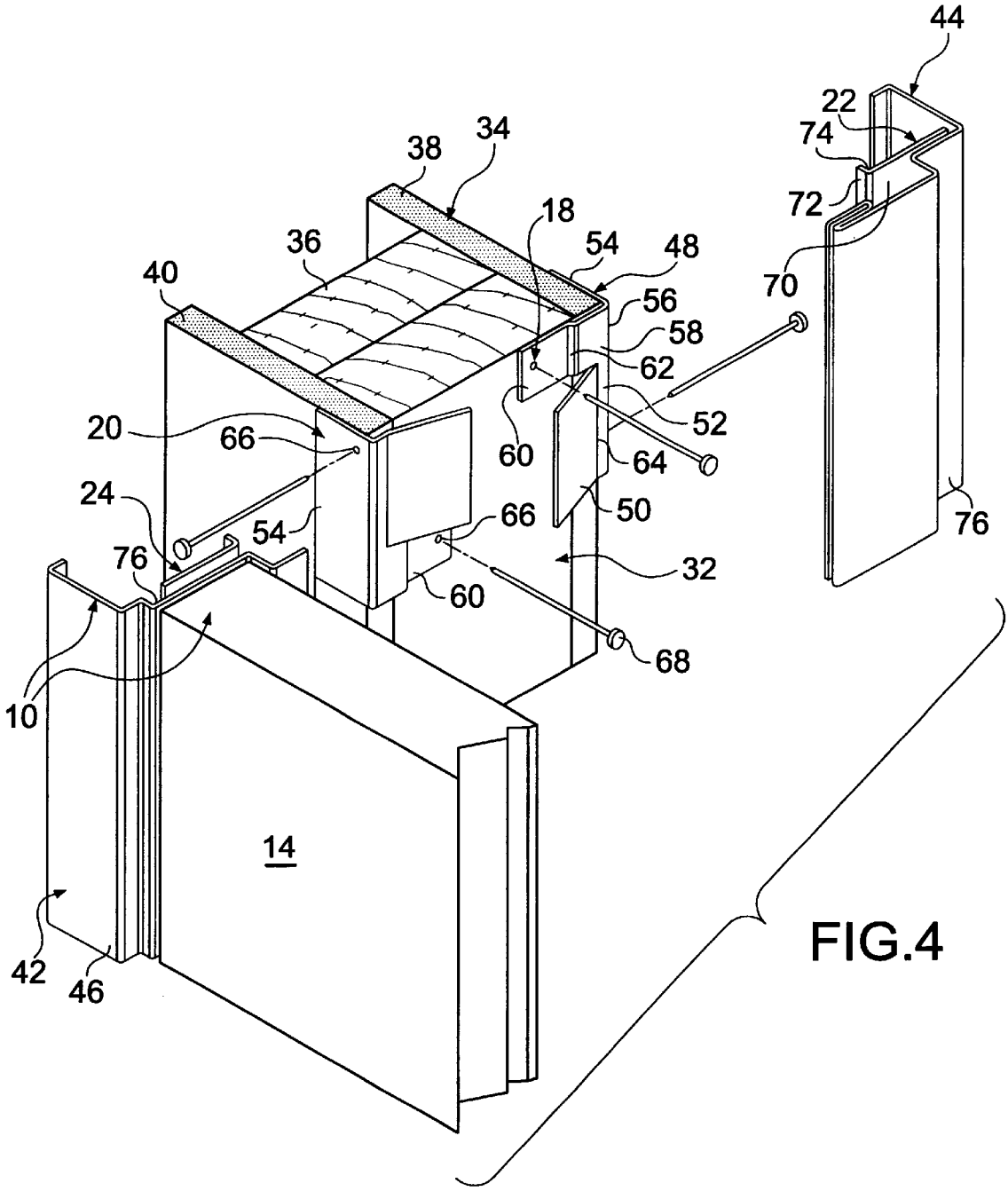
FIG. 4 is an exploded, partial, perspective view of the door frame assembly of FIG. 1.

Referring to FIGS. 1—4, frame assembly 10 according to a first embodiment of the present invention comprises a door frame 12, a door 14 pre-hung within frame 12, and two snap-in couplings 16. Each snap-in coupling comprises two wall anchoring clips 18 and 20 and two steel frame retaining clips 22 and 24.

Door frame 12 includes a hinge jamb 26, a latch jamb 28 and a header jamb 30. The header jamb extends between and connects the hinge jamb and the latch jam. This frame assembly is mounted within doorway opening 32 in a wall 34.

Wall 34, door 14 and door frame 12 can be of any conventional form. For example, the wall can include wood studs 36 on which dry wall panels 38 and 40 mounted. Dimensional variations in the studs and dry walls, as well as the assembly thereof, produce variations in the thickness of the entire wall, i.e., between the oppositely directed surfaces of the two dry wall panels.

Each of the jambs is formed of two members forming a jamb part 42 and a closure part 44. The parts of each jamb are constructed as disclosed in U.S. Pat. No. 5,187,898 incorporated by reference hereinabove. Thus, the details of the form of each of the jambs and parts thereof are not further described in detail.

In the jambs, the flange sections 46 can be planar as illustrated, or can be suitably contoured to provide an ornamental appearance (e.g., of wood moldings).

Since each of the wall anchoring clips 18 and 20 are identical, only one will be described in detail. Wall anchoring clip 18 comprises a base mounting portion 48 and a resilient cantilever portion 50. The base mounting portion includes two substantially perpendicular segments 52 and 54 coupled along a bend 56. Segment 54 is essentially planar and is mounted on wall 34 outside of doorway opening 32, but adjacent to the doorway opening. Base segment 52 comprises an inner part 58 adjacent bend 56 and an outer part 60 remote from the bend. The inner and outer parts are offset in parallel planes in direction of base segment 54, and are connected by a joining part 62 extending generally parallel to but spaced from base segment 54. Joining part 62 is connected to the inner and outer parts along substantially 90 degree bends.

Cantilever portion 50 is formed from a section of base segment 52 by being cut and bent therefrom. The outer periphery of the cantilever portion is generally rectangular. One of its longer edges is connected to a segment 52 along a bend line 64. The cantilever portion is bent relative to the base segment 52 along bend or hinge line 64, such that the cantilever portion extends in a plane which is at a non-perpendicular, acute angle relative to the base segment 52 and at a non-perpendicular, obtuse angle relative to base segment 54.

With the offsetting of the inner and outer parts 58 and 60, bend 56 and bend line 64 will be spaced from the wall by the same distance as the offset, when outer part 60 is engaged with the wall surface defining doorway opening 32. In this manner, the entire cantilever portion is spaced from the wall to allow greater movement thereof, and is spaced closer to the respective retaining clip on the frame to facilitate and to ensure proper engagement therewith. The proper placement of the cantilever portion within the doorway opening is set by the engagement of base segment 54 with the wall outer surface outside of but adjacent to the doorway opening.

Holes 66 extend through base segment 54 and outer part 60. These holes receive fasteners, preferably in the form of nails 68. The nails extend through the holes and into the walls to secure the wall anchoring clips in position.

Since each of the wall anchoring clips is identical, clip 18 is inverted and opposite relative to clip 20. Cantilever portions 50 of clips 18 and 20 are both located in and extend into doorway opening 32. In this manner, the two wall anchoring clips 18 and 20 can be identically configured so that only one part need be manufactured, with the installer only arranging them in opposed and inverted manners, such that each anchoring clip performs properly.

Each of retaining clips 22 and 24 are identical. Each retaining clip comprises a base mounting section 70 and an angled section 72. Sections 70 and 72 are connected along a 90 degree bend 74 such that the two sections are substantially perpendicular.

The base mounting sections of each retaining clip are affixed to an outer surface (i.e., a surface facing the wall) of an inside section 76 of jamb part 42 or closure part 44 of each of the latch jamb and hinge jamb. Preferably, this attachment is accomplished by spot welding. With base mounting sections fixed on the outer surfaces of the jamb part inside sections, the angled section 72 extend parallel to the longitudinally axis of the jamb and perpendicular to the door frame insertion directions.

Door 14 is pre-hung on hinge jamb 26 by hinges 78. The hinges allow the door to open and close in a pivotal and conventional manner. Suitable and conventional latches are provided on the door and the latch jamb.

The door assembly is manufactured at a manufacturing facility with the retaining clips affixed to the jambs as described above. The wall anchoring clips are provided with the assembly but are separable therefrom. At the remote, door installation site, the retaining clips are mounted in the doorway opening, as illustrated and described above. Once the wall anchoring clips are in place, the jamb parts and closure parts of the hinge jamb, the latch jamb and header jamb are installed from opposite sides of the doorway opening to engage in an adjustable manner.

As the jamb parts and closure parts are installed, the angled sections of the retaining clips engage the cantilever portions of the wall anchoring clips causing them to be pivoted or moved in an outward direction as the angled sections ride up toward the free ends of the cantilever portions. Once the angled sections pass the beyond the free ends of the cantilever portions, the cantilever portions will snap back outwardly to engage the angled sections adjacent the base mounting sections of the retaining clips, locking the jamb and closure parts in position.

Suitable fasteners, such as screws, can be mounted out of the normal line of sight of the door i.e., adjacent the top and bottom ends of the latch jamb and hinge jamb, particularly through the member extending into the doorway opening to further secure frame assembly in place. Locating the screws in this manner, out of the normal line of sight, will provide a secure connection, while minimizing the number of screws that need to be installed and without adversely affecting the overall appearance of the door frame assembly.

Figure 6:
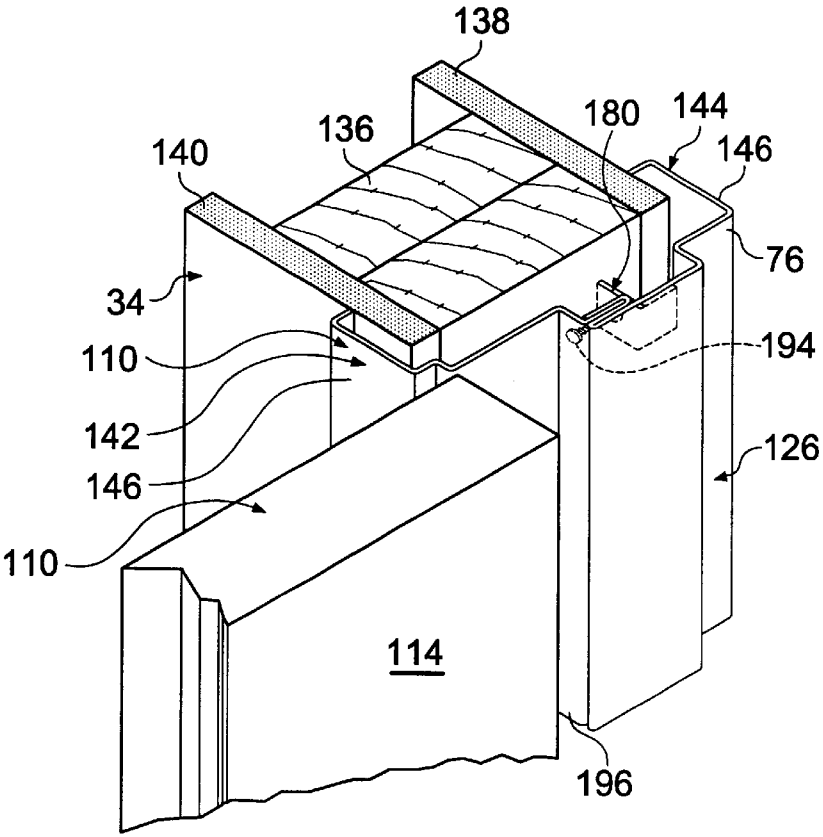
FIG. 6 is a partial, perspective view of the door frame assembly of FIG. 5.
Figure 5:
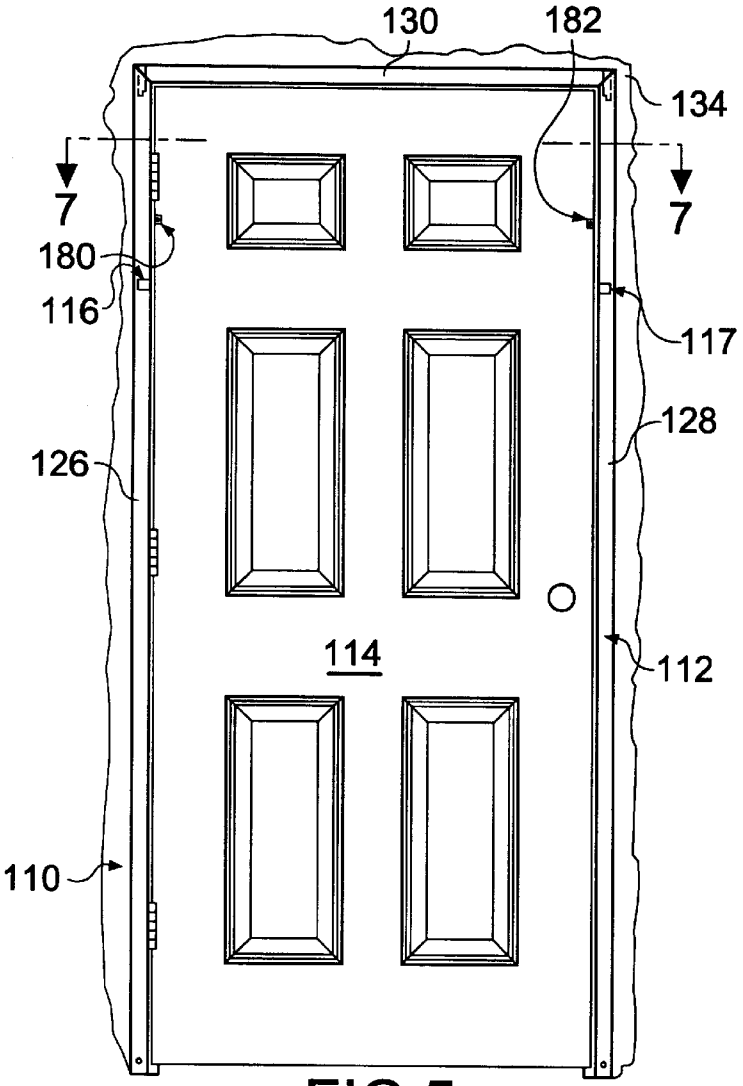
FIG. 5 is a front elevational view of a door frame assembly mounted on a doorway opening in a wall with a mounting coupling according to a second embodiment of the present invention.
Figure 7:
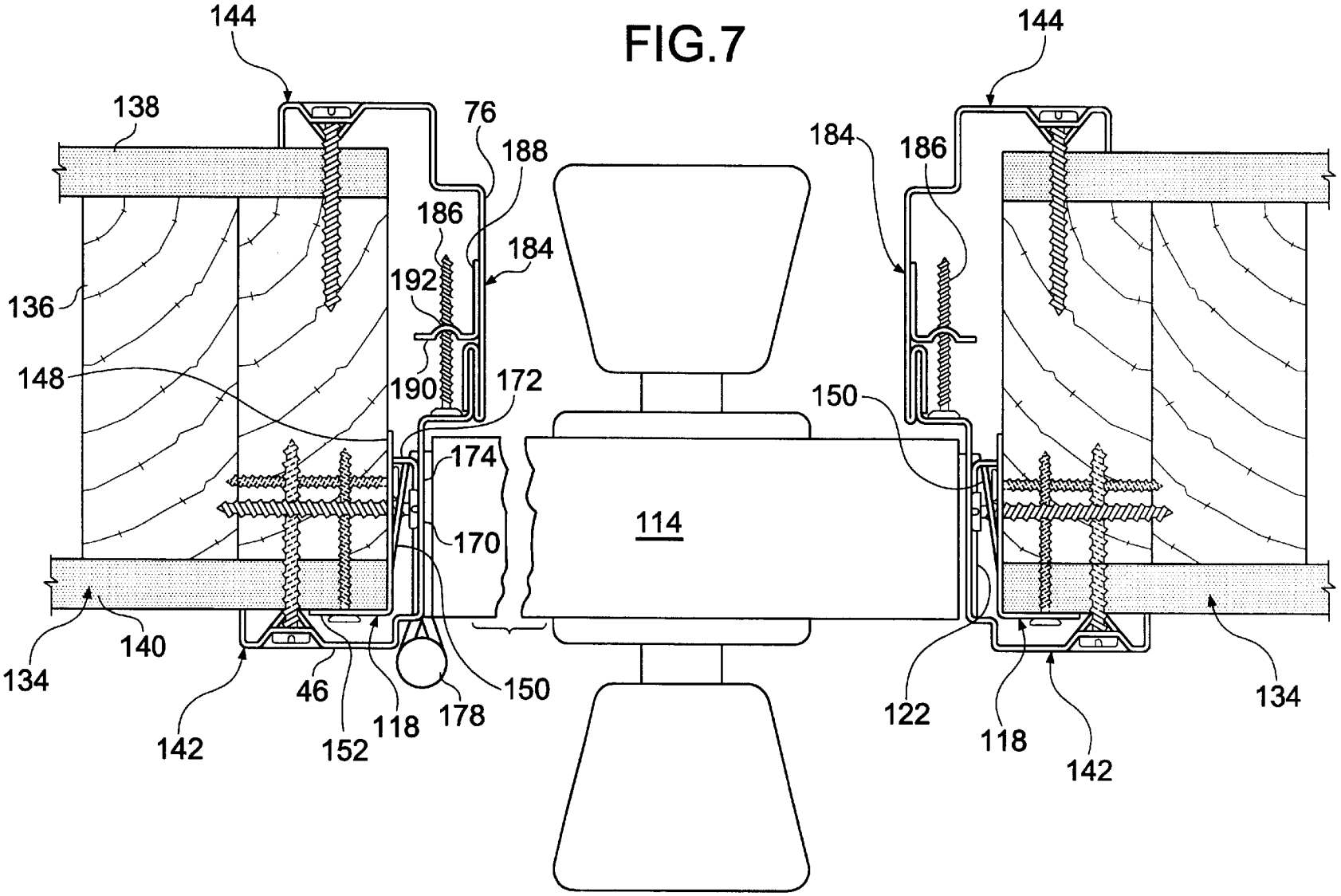
FIG. 7 is a partial top plan view in section taken along line 7—7 of FIG. 5.
Figure 8:
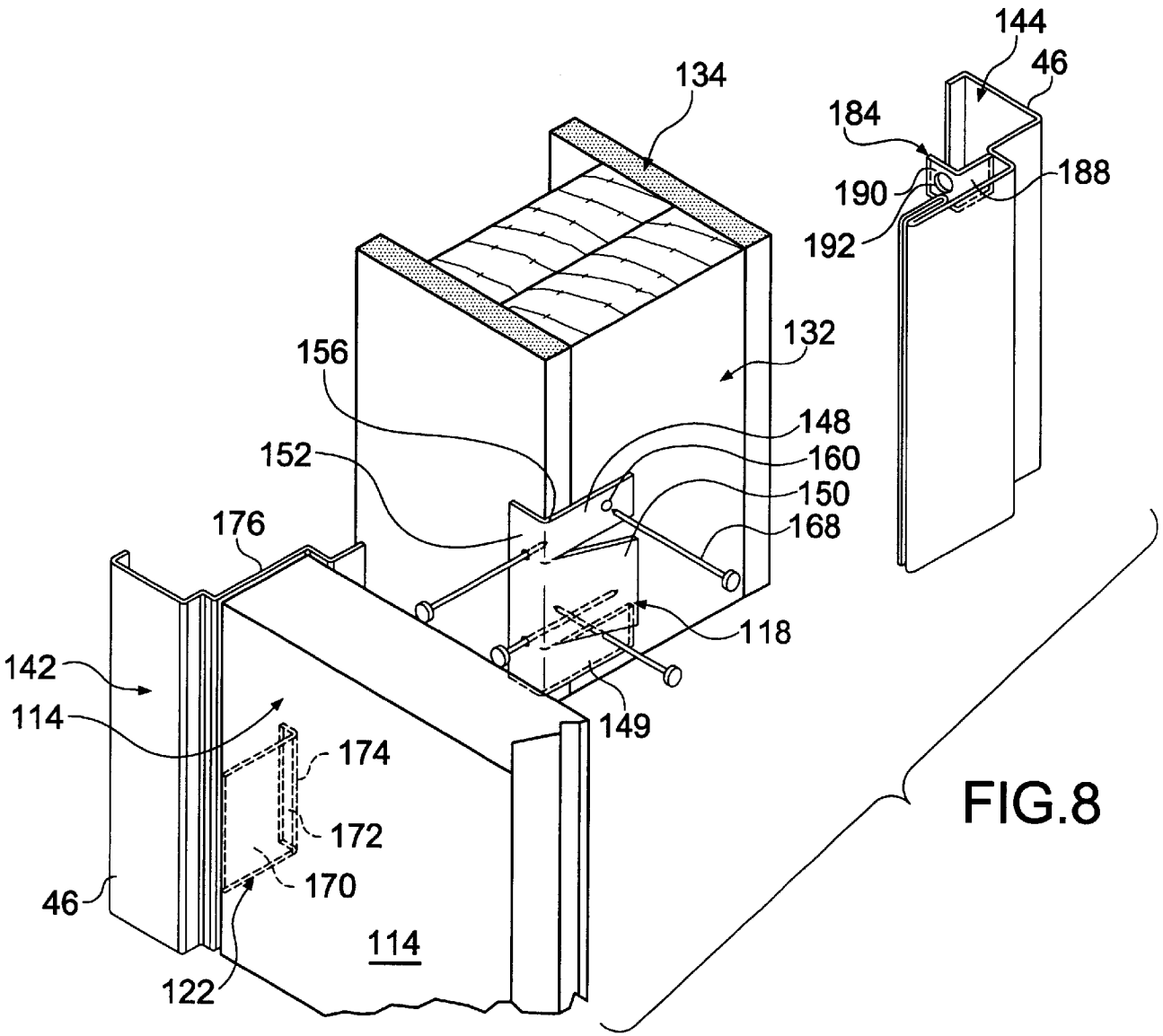
FIG. 8 is an exploded, partial, perspective view of the door frame assembly of FIG. 5.

Referring to FIGS. 5–8, frame assembly 110 according to a second embodiment of the present invention comprises a door frame 112, a door 114 pre-hung within frame 112, and two snap-in couplings 116 and 117. Each snap-in coupling comprises one wall anchoring clip 118 and one steel frame retaining clip 122. The anchoring clips are identical; and the retaining clips are identical.

Door frame 112 includes a hinge jamb 126, a latch jamb 128 and a header jamb 130. The header jamb extends between and connects the hinge jamb and the latch jam. This frame assembly is mounted door doorway opening 132 in a wall 134.

Wall 134, door 114 and door frame 112 can be of any conventional form. For example, the wall can include wood studs 136 on which dry wall panels 138 and 140 mounted. Dimensional variations in the studs and dry walls, as well as the assembly thereof, produce variations in the thickness of the entire wall, i.e., between the oppositely directed surfaces of the two dry wall panels.

Each of the jambs is formed of two members forming a jamb part 142 and a closure part 144. The parts of each jamb are constructed as disclosed in U.S. Pat. No. 5,187,898 incorporated by reference hereinabove. Thus, the thereof are not further described in detail details of the form of each of the jambs and parts In the jambs, the flange sections 146 can be planar as illustrated, or can be suitably contoured to provide an ornamental appearance (e.g., of wood moldings).

Wall retaining clip 118 comprises a base mounting portions 148 and 149 and an intermediate resilient cantilever portion 150. The base mounting portion also includes a substantially perpendicular segment 152 coupled along a bend 156 to portions 148, 149 and 150. Base mounting portions 148 and 149 are mounted on wall 134 inside of doorway opening 132. Segment 152 is mounted outside of doorway opening 132, but adjacent to the doorway opening.

Cantilever portion 150 is formed from a section of base mounting portions 148 and 149 by being cut and bent therefrom. The outer periphery of the cantilever portion is generally rectangular. One of its longer edges is connected to segment 152 along bend line 156. The cantilever portion extends in a plane which is at a non-perpendicular, acute angle relative to the base mounting portions 148 and 149 and at a non-perpendicular, obtuse angle relative to base segment 152. The proper placement of the cantilever portion within the doorway opening is set by the engagement of base segment 152 with the wall outer surface outside of but adjacent to the doorway opening.

Holes 166 extend through base segment 154 and portions 148 and 149. These holes receive fasteners, preferably in the form of nails 168. The nails extend through the holes and into the walls to secure the wall anchoring clips in position.

Since each of the wall anchoring clips is identical and vertically symmetrical, clip 118 for coupling 116 is inverted and opposite relative to clip 118 for coupling 117. Cantilever portions 150 of clips 18 are both located in and extend into doorway opening 132. In this manner, the two wall anchoring clips 118 can be identically configured so that only one part need be manufactured, with the installer only arranging them in opposed and inverted manners, such that each anchoring clip performs properly.

Each of retaining clips 122 are identical. Each retaining clip comprises a base mounting section 170 and an angled section 172. Sections 170 and 172 are connected along a 90 degree bend 74 such that the two sections are substantially perpendicular.

The base mounting sections of each retaining clip are affixed to an outer surface (i.e., a surface facing the wall) of an inside section 176 of jamb part 142 of each of the latch jamb and hinge jamb. Preferably, this attachment is accomplished by spot welding. With base mounting sections fixed on the outer surfaces of the jamb part inside sections, the angled section 172 extend parallel to the longitudinally axis of the jamb and perpendicular to the door frame insertion directions.

Door 114 is pre-hung on hinge jamb 126 by hinges 178. The hinges allow the door to open and close in a pivotal and conventional manner. Suitable and conventional latches are provided on the door and the latch jamb.

Jamb and closure parts 142 and 146 of hinge jamb 126 and of latch jamb 128 are coupled by attachments 180 and 182. Each attachment comprises an attachment clip 184 and a screw 186. Each attachment clip comprises a planar base section 188 and a coupling section 190 extending perpendicularly from its base section along a bend line 190. The base sections are fixedly attached by spot welding to outer surfaces of inside sections 176 of closure parts 144. This attachment is preferably accomplish by spot welding. With base sections 188 affixed on the outer surfaces of the closure part inside sections, coupling sections 190 extend parallel to the longitudinal axes of the closure part and perpendicular to the door frame insertion directions. Coupling sections 190 have internally threaded bores 192.

Screws 186 extend through bores 194 in abutment sections 196 of jamb parts 142. The heads of screws 186 engage the abutment sections adjacent bores 194.

Door assembly 110 is manufactured at a manufacturing facility with retaining clips 112 affixed to the jambs as described above. The wall anchoring clips 118 are provided with the assembly, but are separable therefrom. At the remote, door installation site, the retaining clips are mounted in the doorway opening, as illustrated and described above. Once the wall anchoring clips are in place, the jamb parts and closure parts of the hinge jamb, the latch jamb and header jamb are installed from opposite sides of the doorway opening to engage in an adjustable manner.

As jamb parts 142 are installed, the angled sections of the retaining clips engage the cantilever portions of the wall anchoring clips causing them to be pivoted or moved in an outward direction as the angled sections ride up toward the free ends of the cantilever portions. Once the angled sections pass the beyond the free ends of the cantilever portions, the cantilever portions will snap back outwardly to engage the angled sections adjacent the base mounting sections of the retaining clips, locking the jamb parts in position. Screws 186 can then be passed through bores 194 and threadedly engage bores 192. Tightening screws 186 will fix the coupling of the jamb and closure parts in the appropriated adjusted positions.

Suitable fasteners, such as screws, can be mounted out of the normal line of sight of the door i.e., adjacent the top and bottom ends of the latch jamb and hinge jamb, particularly through the member extending into the doorway opening to further secure frame assembly in place. Locating the screws in this manners out of the normal line of sight, will provide a secure connection, while minimizing the number of screws that need to be installed and without adversely affecting the overall appearance of the door frame assembly.

As described above and illustrated in the drawings, the resilient cantilever portions are mounted on the wall anchoring clips attached to the wall, while the angled sections are mounted on the retaining clips affixed to the door frame jambs. However, this orientation could be reversed such that the resilient cantilever portions are mounted on the door frame jambs and the angled sections are mounted on the wall. Similarly, the mounting of screw 196 on jamb parts 142 and of attachment clips 184 on closure parts 144 can be reversed.

While particular embodiments have been chosen to illustrated the invention, it will be understood by those skilled in the art that various changes and modifications can be made therein without departing from the scope of the invention as defined in the appended claims.

What is claimed is:

1. A coupling for mounting a door frame having a plurality of door jambs in an opening in a wall, which opening is defined by a plurality of wall portions, comprising:

substantially identical, first and second anchoring clips, each of said anchoring clips having a base mounting portion and a resilient cantilever portion extending at a non-perpendicular angle from said base mounting portion, said anchoring clips being oriented adjacent and facing one another and mountable on one of the door jambs and one of the wall portions; and substantially identical, first and second retaining clips attached to an adjacent door jamb, each of said retaining clips having a base mounting section and an angled section extending in a cantilever manner from said base mounting section thereof, said first and second retaining clips being oriented in mirror image to one another such that said cantilever portions of said first and second anchoring clips engage said angled sections of said first and second retaining clips, respectively.

2. A coupling according to claim 1 wherein each said base mounting portion comprises substantially perpendicular first and second segments coupled along a bend.

3. A coupling according to claim 2 wherein said cantilever portion of each said anchoring clip extends at an acute angle to said first segment thereof.

4. A coupling according to claim 3 wherein each said first segment comprises an inner part adjacent said bend and an outer part remote from said bend, said inner and outer parts thereof being offset in parallel planes in a direction of said second segment.

5. A coupling according to claim 2 wherein said segments have holes for receiving fasteners.

6. A coupling according to claim 1 wherein each said base mounting section is planar.

7. A coupling according to claim 6 wherein each said angled section is substantially perpendicular to said base mounting section thereof.

8. A coupling according to claim 1 wherein said cantilever portions extend in generally opposite directions.

9. A door frame assembly mounted in an opening in a wall, comprising:

a hinge jamb;

a latch jamb;

a header jamb extending between and connecting said hinge jamb and said latch jamb;

substantially identical, first and second anchoring clips attached to one of said jambs, each of said anchoring clips having a base mounting portion and a resilient cantilever portion extending at a non-perpendicular angle from said base mounting portion, said anchoring clips facing one another; and substantially identical first and second retaining clips attached to the other of said jambs, each of said retaining clips having a base mounting section and an angled section extending in a cantilever manner from said base mounting section thereof, said first and second retaining clips being oriented in mirror image to one another such that said cantilever portions of said first and second anchoring clips engage said angled sections of said first and second retaining clips, respectively.

10. A door frame assembly according to claim 9 wherein each said base mounting portion comprises substantially perpendicular first and second segments coupled along a bend, said first segments being mounted on said wall outside said opening, said second segments being mounted on said wall and extending into said opening.

11. A door frame according to claim 10 wherein said cantilever portion of each said anchoring clips extends at an acute angle to said first segment thereof toward said door frame.

12. A door frame assembly according to claim 11 wherein each said first segment comprises an inner part adjacent said bend and an outer part remote from said bend, said inner and outer parts thereof being offset in parallel planes.

13. A door frame assembly according to claim 10 wherein said segments having holes; and fasteners extend through said holes and are adapted to extend into said wall.

14. A door frame assembly according to claim 9 wherein each said base mounting section is planar and is fixed on an outer surface of said one of said jambs.

15. A door frame assembly according to claim 14 wherein each said angled section is substantially perpendicular to said base mounting section thereof.

16. A door frame assembly according to claim 9 wherein a pre-hung door is pivotally coupled to said hinge jamb.

17. A door frame assembly according to claim 9 wherein each of said jambs comprises first and second members which are adjustably coupled to accommodate different wall thicknesses.

18. A door frame assembly according to claim 17 wherein said first and second members of at least one of said jambs have an attachment clip with an internally threaded hole attached to said first member and a threaded fastener extending through a hole in said second member and threadedly engaged in said internally threaded hole.

19. A door frame assembly according to claim 17 wherein said first anchoring and retaining clips are associated with and retain said first member; and said second anchoring and retaining clips are associated with and retain said second member.

20. A coupling for mounting a door frame in an opening in a wall, comprising:

substantially identical, first and second anchoring clips, each of said anchoring clips having a base mounting portion and a resilient cantilever portion extending at a non-perpendicular angle from said base mounting portion, each base mounting portion having substantially perpendicular first and second segments coupled along a bend, said cantilever portion of each said anchoring clip extending at an acute angle to said first segment thereof, each said first segment having an inner part adjacent said bend and an outer part remote from said bend, said inner and outer parts thereof being offset in parallel planes in a direction of said second segment, said anchoring facing one another; and substantially identical, first and second retaining clips, each of said retaining clips having a base mounting section and an angled section extending in a cantilever manner from said base mounting section thereof, said first and second retaining clips being oriented in a mirror image to one another such that said cantilever portions of said first and second anchoring clips engage said angled sections of said first and second retaining clips, respectively.

* * * * *